US005782469A

United States Patent [19]

Schoon et al.

[11] Patent Number: 5,782,469

[45] Date of Patent: Jul. 21, 1998

[54] STACKING DEVICE FOR CARD-SHAPED PRODUCTS

[75] Inventors: Jürgen Schoon, Eberbach; Heinrich Volk, Beerfelden, both of Germany

[73] Assignee: Esselte Meto International GmbH, Heppenheim, Germany

[21] Appl. No.: 680,510

[22] Filed: Jul. 9, 1996

[30] Foreign Application Priority Data

Nov. 6, 1995 [DE] Germany ..... 195 41 278.8

[51] Int. Cl.[6] ..... B65H 29/38

[52] U.S. Cl. ..... 271/177; 271/215; 271/223

[58] Field of Search ..... 271/177, 180, 271/181, 223, 224, 215, 213, 220

[56] References Cited

U.S. PATENT DOCUMENTS

| | | | |
|---|---|---|---|
| 3,994,487 | 11/1976 | Wicklund | 271/223 |
| 4,474,366 | 10/1984 | Reider | 271/181 |
| 4,844,438 | 7/1989 | Mistyurik et al. | 271/181 |
| 5,411,252 | 5/1995 | Lowell | 271/223 |
| 5,551,834 | 9/1996 | Thompson et al. | 271/180 |

FOREIGN PATENT DOCUMENTS

| | | | |
|---|---|---|---|
| 1173893 | 5/1959 | France | 271/177 |
| 6 67 698 | 11/1938 | Germany . | |
| 33 679 | 12/1964 | Germany . | |
| 34 25 397 A 1 | 1/1985 | Germany . | |
| 1 047 055 | 2/1964 | United Kingdom . | |

*Primary Examiner*—H. Grant Skaggs
*Attorney, Agent, or Firm*—Darby & Darby

[57] ABSTRACT

A stacking device for stacking card-shaped products in vertically upright positions. The stacking device has a brake stop that is flexible in the moving direction of the card-shaped products and mounted on a rocker-type drivable component. The rocker presses against the stack end in the stacking direction to advance the stack to receive additional products. The stacking device further includes a stack receiver defining the front end of the stack and including a holding bracket with a bearing surface. The stack receiver preferably is adjustable to accommodate varying widths of products to be stacked.

26 Claims, 5 Drawing Sheets

STACKING DEVICE FOR CARD-SHAPED PRODUCTS

BACKGROUND OF THE INVENTION

The present invention relates to a stacking device for card-shaped products, such as labels, that are conveyed one after another in the direction of their surface plane.

A stacking device of a related type is described in U.S. Pat. No. 4,844,438 to Mistyurik et al., which patent specification is hereby incorporated by reference in its entirety. To stack card-shaped products, such as labels, a conveyor arrangement is provided that uses a multiplicity of rolls arranged on a curved path to transport card-shaped products—in particular labels—that are oriented in the horizontal direction and generally come from a printer or an upstream cutting unit. The device turns the cards upward by a 90° angle so that they finally stand substantially vertically. The labels are then slid onto a support surface using a rocker-like component to produce a stack of card-shaped products that are arranged standing or sliding with one longitudinal edge (typically the shorter edge) on a support surface. A rigid, vertically-adjustable brake stop is provided on the rocker-like component, and is used to brake the vertical movement of the labels. The brake stop surface facing the entering products is angled toward the top, i.e., in the moving direction of the products coming from the conveyor arrangement, so that individual, longer labels, which are interposed as dividing labels between shorter labels of equal length, can be processed. In addition, a weight is provided on the end (opposite the rocker-like component) of the stack on the support surface. This weight is pushed along by the growing stack and is used to activate a sensor, which indicates a full stack.

One disadvantage of the known stacking device is that it is not possible to process separating labels that are significantly (i.e., more than a few millimeters) longer than the other labels. In that case, the aforementioned angle of the brake stop is not sufficient to accept longer labels, so that the labels get jammed between the conveyor arrangement on one end and the brake stop on the other end. Moreover, the weight provided on the end of the stack is not adjustable to the type of label, so that it is possible (when using very large, heavy labels) for the end of the stack that is adjacent to the weight to tip over in a detrimental fashion because the mass of the weight is too low.

SUMMARY OF THE INVENTION

A principal object of the present invention is therefore to improve a stacking device of the type described above so that it is suitable for operation with card-shaped products of varying sizes.

It is a further object of the present invention to provide an adjustable bracket for supporting a stack of card-shaped products of varying heights and/or widths.

These and other objects of the present invention are accomplished in accordance with the principles of the present invention by providing a stacking device, such as the type described above, with a brake stop that is flexible in the moving direction of the card-shaped products coming from the conveyor arrangement of the device.

It has proven to be advantageous for a brake stop, arranged obliquely to the direction of movement of the conveyor arrangement, to be provided on the rocker-type drivable component. This rocker-type component presses in the stacking direction against the stack end facing the conveyor arrangement, thereby causing the stack to advance on the support surface. The brake stop of the present invention is flexible and preferably preloaded in the direction of conveyance. In that way the kinetic energy of the conveyed cards can be absorbed without damage to the edges of the cards. Moreover, shorter and longer cards can be processed at the same time in the same stack. The brake stop is preferably vertically adjustable to various card heights.

It is preferable for the brake stop to be angled toward the top, against the moving direction of the card-shaped products that are exiting the conveyor arrangement, so that the brake stop can easily be lifted by the front edge (in the moving direction) of an entering label. The angle facing the card-shaped products between the surface of the brake stop facing the entering products and the rocker-like drivable component is therefore preferably more than 90°. In other words, the angle between the rocker arm and brake stop (in its rest position), measured from the top, is preferably less than 90°. That choice of an angle prevents the products from becoming jammed between the rocker-like drivable component and the brake stop.

The brake stop is also beneficially pivoted around a horizontal axis that runs obliquely to the moving direction of the products and is preloaded by a spring.

Another feature of the present invention relates to a region of the device that receives the stack. A holding bracket that can be moved in the stacking direction is provided. It defines the front stack end in the stacking direction. The holding bracket may be supported, for example, on the guide surface or may be guided so it can slide. Alternatively, the holding bracket may preferably be held so it can slide on a lateral face which supports the stack in the lateral direction. To adjust the resistance that the holding bracket exerts against the stacked cards, an embodiment of the invention is provided in which the holding bracket is braked by means of a brake device so the holding bracket can slide. The braking force of the brake device is preferably adjustable and preferably includes a sliding friction stop.

A further feature of the present invention is the provision of a guide device that guides the card-shaped products to prevent the cards from getting under a belt drive or twisting on a belt during conveyance. The guide device preferably also includes a spring element that pushes the card-shaped products in the stacking direction to ensure that the labels are acted upon uniformly.

BRIEF DESCRIPTION OF THE DRAWINGS

Additional characteristics, details, and advantages of the invention are described in the following description of a preferred embodiment of the invention, and are shown in the attached drawings, wherein like reference numerals represent like elements and in which.

DETAILED DESCRIPTION OF THE INVENTION

Figure 1:
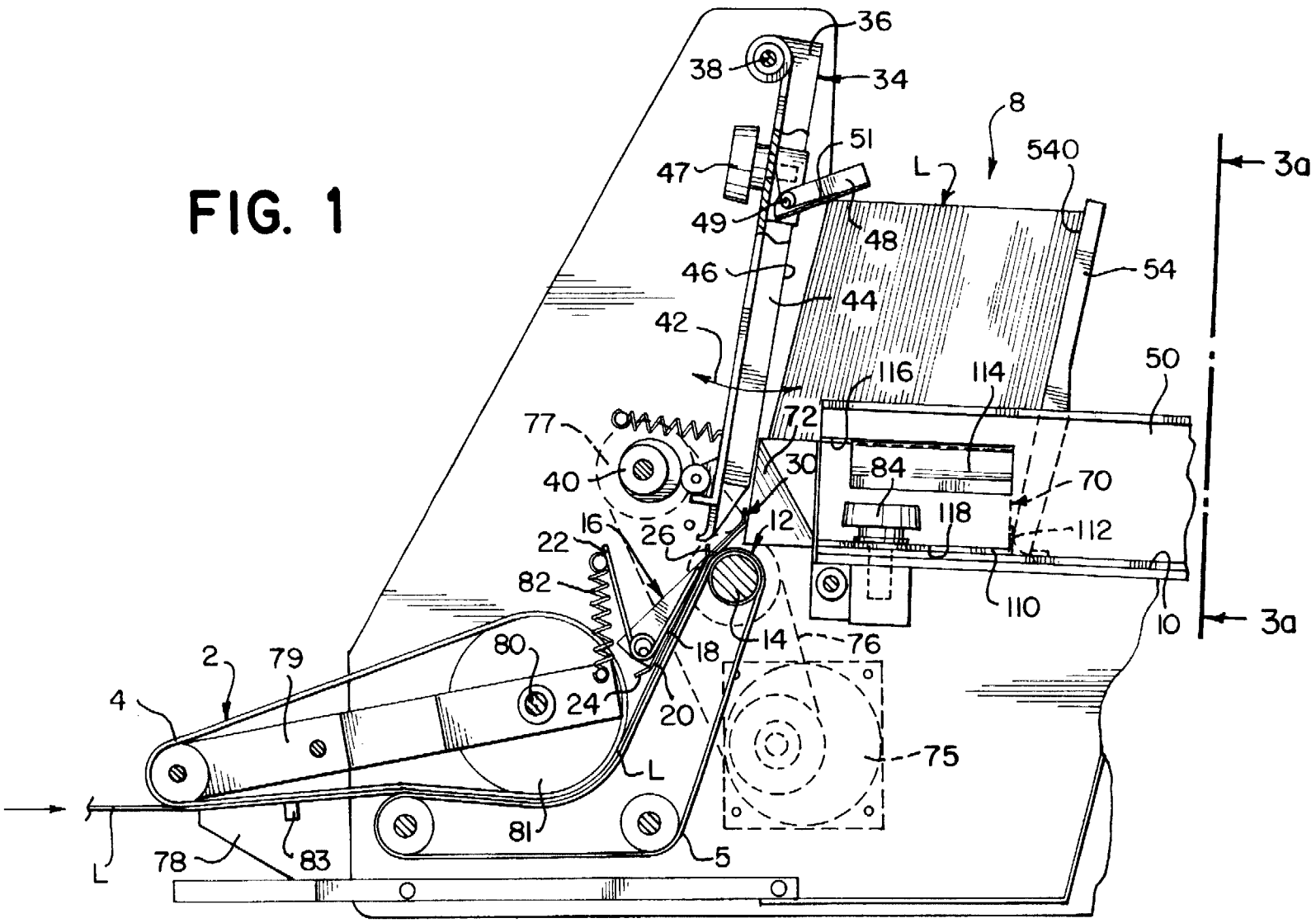
FIG. 1 is a side elevational view of a stacking device in accordance with the principles of the present invention.

FIG. 1 shows a stacking device, e.g., for labels separated in an upstream cutting unit from a flat material strip. The basic structure of the stacking device may be formed like that of the aforementioned U.S. Pat. No. 4,844,438. The elements L to be stacked are conveyed from the left as shown in FIG. 1. The stacking device includes a conveyor arrangement 2 having a first (upper) belt drive 4 and a second (lower) belt drive 5. Preferably, at least the second belt drive 5 is constructed as a flat belt drive. The labels are conveyed in a horizontal position between the belt drives 4 and 5 in the direction toward their stacking position 8. When the labels are conveyed in this manner, the labels that are conveyed in the direction of their surface plane (i.e., horizontally) are turned by almost 90° and are stacked so they are standing substantially vertical and against each other on their lower narrow sides or edges on a support surface 10. The second belt drive 5 is guided in the end region 12 of the conveyor arrangement 2 around a deflection roller 14. The jacket surface of roller 14, and therefore the transport or upper side of its belt drive 5, runs almost in the plane of the support surface 10, and preferably slightly above that plane, so that the labels being conveyed are standing with their lower edge on the deflection roller 14, or the belt drive 5 when they leave the conveyor arrangement 2 and from there are directly delivered to the support surface 10. Thus, the label edge facing the supporting surface is transferred to the supporting surface by the conveyor belt and is not, as in the prior art devices, essentially removed from the supporting surface when the lower edge of the label which is to be deposited on the supporting surface leaves the conveyor belt. Due to the inventive guidance of the belt drive 5, the label upper edge (opposite supporting surface 10) is supported by the most recently deposited label, as a result of which a significant tilting of the label that is to be deposited, and therefore an "ejection" of the label from the stacking device, is prevented. The upper edge of the label which is to be deposited does not protrude, or protrudes only very slightly, beyond the corresponding upper edges of the respective labels which have already been stacked. Thus, the label, when being deposited, is supported or guided by the already formed stack over almost its whole height.

The conveyor arrangement 2 can be driven by a direct current motor 75. The two belt drives 4, 5 are placed into motion by the direct current motor 75 via a driving belt 76, which is preferably a toothed belt. The latter activates the deflection roller 14 via a toothed wheel arranged on the end region 12 of the conveyor arrangement 2 with a driving torque, while an additional eccentric cam 40, which is described in greater detail below, is placed into rotation by the driving belt 76 via a second toothed wheel 77.

As shown in FIG. 1, the labels to be stacked are conveyed from the left side between the half of the first belt drive 4 located at the bottom and a table 78 secured to the stand of the stacking device. To prevent undesirable vibrations of the first belt drive 4 and a rocker arm 79 that supports it, particularly at high conveyance speeds, the rocker arm 79 pivots about a horizontal axis 80 running orthogonal to the plane of the drawing on the axis of rotation of a rear deflection roller 81 of the belt drive 4 which is toward the stacking position 8. A coil spring 82 is secured on the rear face—which lies behind the axis 80—of the rocker arm 79 and pulls rocker arm 79 upwards. The result is that the rocker arm 79 on the front face, which is the intake position for the labels, is also acted upon by the pressure of spring 82 in addition to gravity, which pushes it against the table 78. This arrangement prevents the undesirable vibrations.

It should also be noted that the first belt drive 4 is not driven directly by the direct current motor 75, but rather via the second belt drive 5, which itself is in contact with the belt 4 over part of the region where it contacts deflection wheel 81, and drives belt 4 by friction. The half of the second belt drive 5 that is in contact with the labels is turned upward by about 60° on the deflection wheel 81.

A sensor 83 is installed on the surface of the table 78 facing the labels that are guided past it. Sensor 83 operates according to the principle of reflection and is used to detect any pile-up of the labels. In particular, the labels are separated when they move past the sensor under normal operation. The sensor expects these gaps, which produce no reflection, on a periodic basis. If they do not occur, indicating that labels are jammed in the device, an error signal is created. In such a case, the direct current motor 75 and a label printer or cutter connected upstream of the stacking device are switched off, in order to prevent damage to the equipment and labels.

A guide device 16 in the form of a baffle plate 18 is provided at a downstream end, in the transport direction of conveyer arrangement 2, before the deflection roller 14 of the second belt drive 5. Baffle plate 18 faces the upper side of the belt drive 5 and forms with the upper side of belt drive 5 a guide slit 20, through which the labels to be deposited are conveyed. Thus, the whole of the label surface is acted upon two-dimensionally, thereby preventing it from being forced under a belt drive or twisted on a belt drive during conveyance. The baffle plate 18 is preloaded by a coil spring 22 in the direction toward the upper side of the belt drive 5. A label passing through the guide slit 20 is pressed by the baffle plate 18 onto the upper surface of the belt drive 5 and subsequently conveyed by it, whereby the upper side of the label slides on the baffle plate 18. The baffle plate 18 has border regions 24, 26 running oblique to the transport direction and bent away from the upper side of the belt drive 5 to form a rounded guiding surface.

Figure 2:
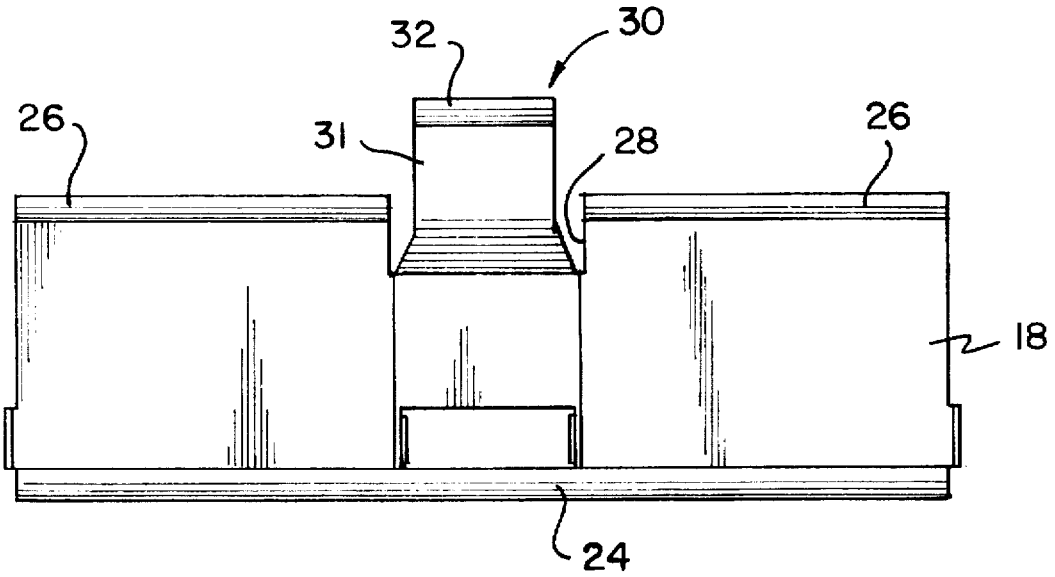
FIG. 2 is a detailed view of a baffle plate of the stacking device in accordance with FIG. 1.

As shown in particular in FIG. 2, which illustrates a top view of the baffle plate 18, an open-edge recess 28 is formed in a center region, in which a spring element 30 is arranged. The spring element 30 preferably is disposed centrally with respect to the baffle plate 18, in order to ensure that the labels which are to be deposited are acted upon uniformly. As can be seen in FIG. 1, the spring element 30 projects beyond the deflection roller 14 of the second belt drive 5 in the direction of the stacking position 8. The spring element 30 is formed by a spring tongue 31 and, like the baffle plate 18, has a bent border region 32. It is advantageous to pretension spring element 30 in the direction of the stacking position 8. The spring element 30 presses the label to be deposited away from baffle plate 18 and toward the direction of support surface 10 and the stacking position 8. Moreover, the spring element advantageously is disposed so that it interacts with the lower edge region (on the supporting surface side of a label), while the label is being deposited or moved into the stack. Because the label already lies with its upper edge against the stack, it is reliably deposited or laid against the stack in this manner.

When card-shaped products (such as labels) are conveyed from the left into the stacking device, they are accelerated by turning belt drives 4, 5 to a higher speed in order to form spaces between the labels. The labels are transported onto the belt drive 5 in the region of the guide slit 20 by the pressure of the baffle plate 18. When the front edge (in the transport direction) of a label reaches the bent border region 26 of the baffle plate 18 and presses against the side of the spring tongue 31 facing the belt drive 5 (in FIG. 1 that edge of spring tongue 31 is pushed to the left at border region 32), the label is moved toward the stack by the spring tongue 31. As the rear edge (in the transport direction) of the label leaves the guide slit 20 and to some extent stands on the deflection roller 14, the spring tongue 31 springs back to its position illustrated in FIG. 1, which presses the label securely into its stacked position.

To ensure that the already-stacked labels in FIG. 1 are moved further to the right, so that a pile-up does not occur in the end region of the conveyor arrangement 2, a rocker arm 34 (which may be formed like the rocker arm of U.S. Pat. No. 4,844,438) is provided that pivots in the region of its upper edge 36 around an axis 38. The rocker arm 34 is moved back and forth in the direction of the double arrow 42 via the eccentric cam 40. A plurality of vertically extending bars 44 that run parallel to each other are provided on the side of the rocker arm 34 facing the stacking position 8, which bars press with their faces 46 against the last label deposited in the stack, thereby causing the stack to advance.

A brake stop 48 is provided between the bars 44 so that it is vertically adjustable in a vertical slot in rocker arm 34 by means of an adjusting screw 47. The brake stop 48 pivots flexibly about axis 49 in the transport direction of the labels (i.e., upwards) and is preloaded against the transport direction by spring 51. Spring 51 preferably is wound around axis 49 and has two ends. One end of spring 51 is supported on rocker arm 34, and the other end of spring 51 presses against brake stop 48. Brake stop 48 cooperates with the front edge (in the transport direction) of labels being conveyed to the stacking position 8. Preferably, brake stop 48 is formed from any suitable metal and includes a lower surface (that contacts the products to be stacked) that is preferably coated with, for example, rubber.

The height of brake stop 48 is preferably selected such that incoming products do not (or only to a small extent) move the brake stop 48 upward. When larger products (e.g., every one hundredth label, which is used to separate other, shorter, labels) are advanced to brake stop 48, brake stop 48 moves upward against spring 49. For this reason, the angle between rocker arm 34 and brake stop 48 (in its rest position) measured from the top is preferably less than 90°.

Figure 3B:
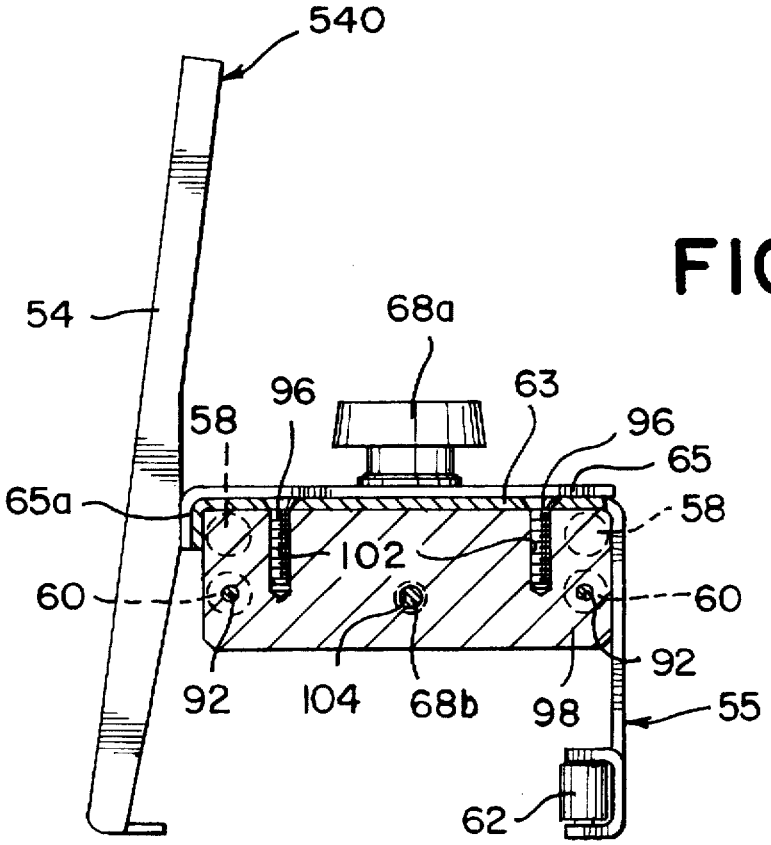
FIG. 3*b* is a partial sectional view of the bracket assembly, viewed along line 3*b*—3*b* of FIG. 3*a;*
Figure 3A:
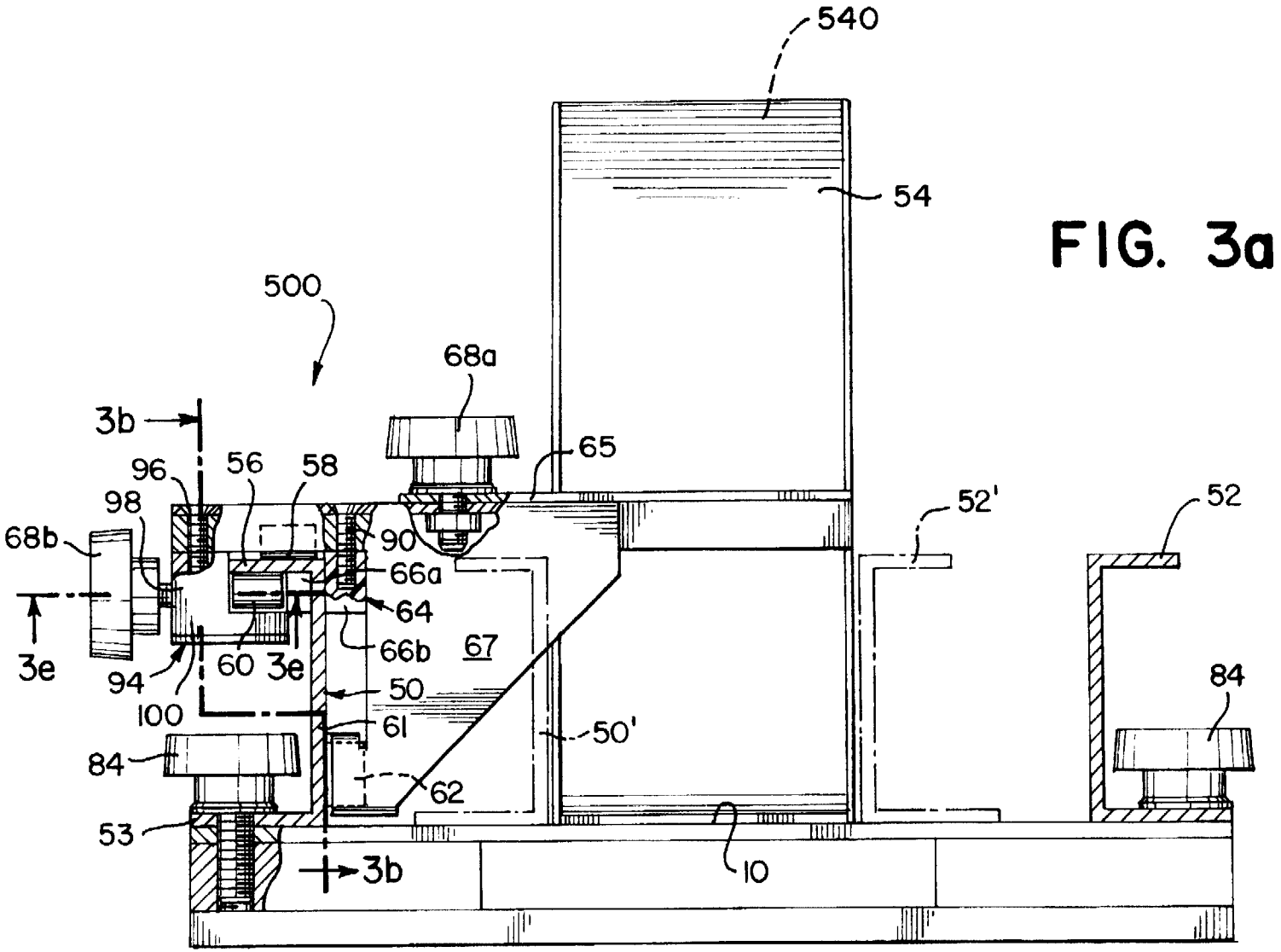
FIG. 3*a* is a detailed view of a stack receiving region of the stacking device viewed along line 3*a*—3*a* of FIG. 1.

FIG. 3*a* shows a region of the stacking device (along line 3*a*—3*a* of FIG. 1) that receives the stack; that region is delimited from below by the support surface 10 and laterally by lateral cheeks 50, 52. The cheeks 50, 52 have a C-shaped cross section and can slide oblique to the stacking direction. Preferably, lower cheek section 53 (present in each of cheeks 50, 52) is provided with a long hole through which screw 84 is threaded. The position of cheeks 50, 52 may be adjusted in the longitudinal direction, i.e., in the direction of the motion of the labels, by the adjusting screws 84. Further, the positions of the cheeks can be adjusted laterally by screws 68*a* and long slots in plate 65 of holding bracket 54 to second closer positions 50' and 52' illustrated in FIG. 3*a* in phantom.

In particular, FIG. 3*a* shows a movable bracket assembly, designated in its entirety by reference character 500, that provides a bearing surface 540 for supporting card-shaped products L as they are stacked along support surface 10. Holding bracket 54 is coupled to cheek 50 via plate 65 and connection bracket 55. A similar arrangement is provided for cheek 52, but is not shown in the drawings for the sake of clarity. Bracket assembly 500 is held on the lateral cheek 50 so that holding bracket 54, which holds the stacked cards in an upright position against bearing surface 540, can slide in the stacking direction with lateral cheek 50. For that purpose, an upper cheek section 56 which is angled perpendicularly outward from the stack, is arranged between two contact rollers 58 and 60 which are coupled to bracket assembly 500, as described in greater detail below, so that rollers 58 and 60 roll on upper cheek section 56. In addition, bracket assembly 500 is supported on the cheek 50 by means of an additional contact roller 62 which is supported on vertical part 67 of bracket 55 and rotates along vertical portion 61 of cheek 50 about an axis perpendicular to the rotation axis of rollers 58, 60.

Figure 3C:
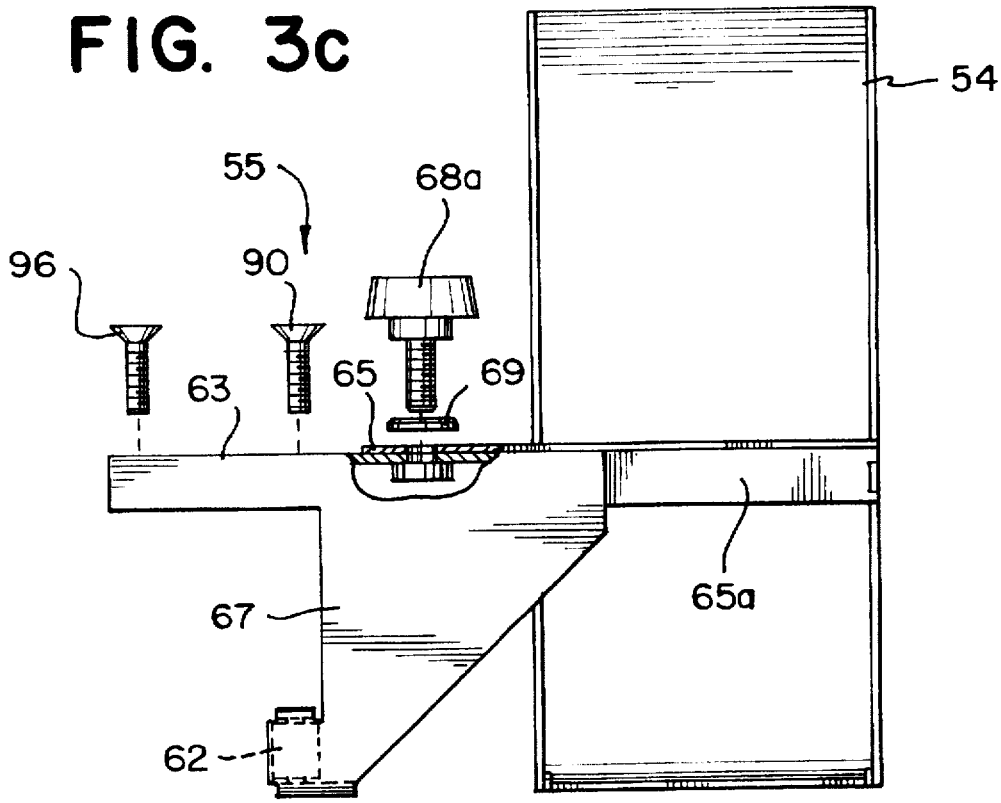
FIG. 3*c* is an isolated, partially exploded view of the bracket assembly shown in FIG. 3*a;*
Figure 3D:
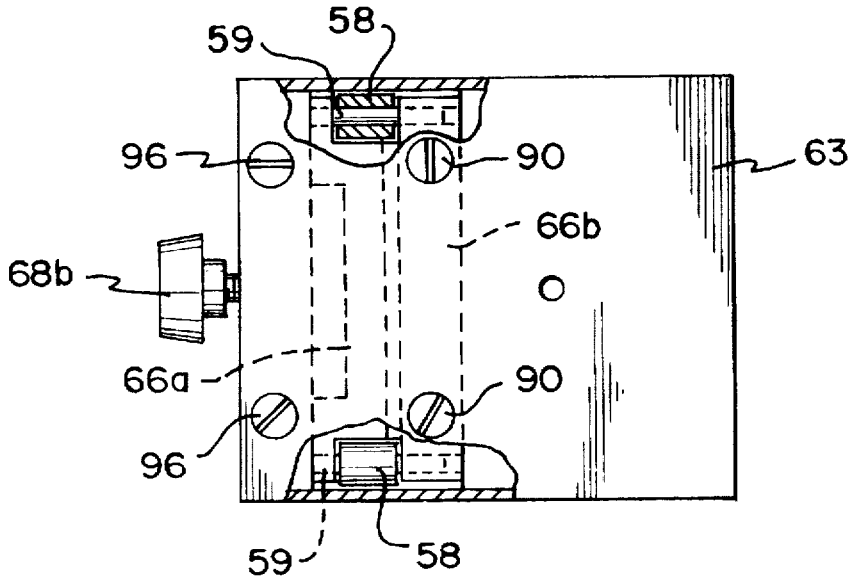
FIG. 3*d* is a top view of the connection bracket of FIGS. 3*a* and 3*c;*

A side view (along line 3*b*—3*b* of FIG. 3*a*) of holding bracket 54 and the connection bracket 55 which couples holding bracket 54 to cheek 50 is shown in FIG. 3*b*. As may be seen, bracket 54 is preferably at an angle of about 8° with respect to support surface 10, angled away from the stack. Bracket 54 is coupled to upper portion 63 of connection bracket 55 via the rectangular, preferably metal, plate 65 of bracket 54 and screw 68*a*. Plate 65 has a downwardly extending flange 65*a* by which bearing surface 540 is connected to plate 65 as may be seen in FIGS. 3*b* and 3*c*. FIG. 3*c* shows an exploded view of a portion of bracket assembly 500. As may be seen, a washer 69 may be provided between screw 68*a* and plate 65. To allow the relative positions of cheeks 50 and 52 to be adjusted, it is preferable that the position of bracket 55, and hence cheek 50, be adjustable with respect to bracket 54 which is maintained at a substantially centered position. Accordingly, the position of bracket 54 with respect to cheek 50 may be adjusted via adjusting screw 68*a*. A long hole may be provided in one of upper portion 63 and plate 65 to facilitate such adjustment. FIG. 3*d* shows a top view of connection bracket 55, with top portion 63 broken away to show the positions of rollers 58 their respective axles 59. Also, plastic pressure pieces 66*a* and 66*b* (discussed in greater detail below) may be seen in phantom.

Figure 3E:
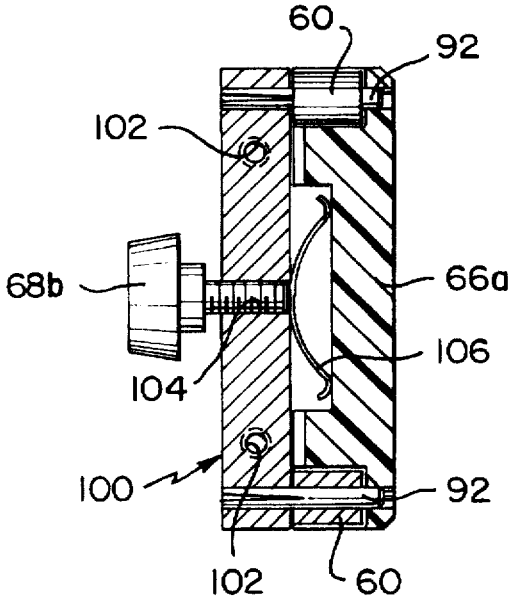
FIG. 3*e* is a partial sectional view of the bracket assembly of FIG. 3*a* viewed along line 3*e*—3*e* of FIG. 3*a*.

The holding bracket 54 includes a brake device 64, which is comprised of two opposing plastic (preferably Teflon) pressure pieces 66*a* and 66*b* (also not shown in FIG. 3*b*), which can be pressed by means of an adjustment screw 68*b* (described in further detail below) against the cheek 50 and thereby provide a pre-specified sliding stop. As shown, vertical portion 61 of cheek 50 is sandwiched between left plastic pressure piece 66*a* and right plastic pressure piece 66*b*. Plastic pressure pieces 66*a* and 66*b* preferably extend across the whole width of connection bracket 55 (i.e., across the width of top portion 63, from top to bottom in FIG. 3*d*). Right plastic pressure piece 66*a* is preferably coupled to upper portion 63 of connection bracket 55 via screws 90. Left plastic pressure piece 66*b* is supported by axles 92, on which rollers 60 are supported and rotate, as may be seen in FIG. 3*e*. Axles 92 are supported by L-shaped piece 94 which is connected to upper portion 63 of connection bracket 55 via screws 96. In particular, vertical portion 98 of L-shaped piece 94 is supported by screw 96 and supports axles 92. A cross-section through L-shaped piece 94, along line 3*e*—3*e*, is shown in FIG. 3*e*. Through holes 102 (for screws 96) and 104 (for screw 68*b*) through vertical portion 98 may be seen. Brake device 64 includes, in addition to plastic pressure pieces 68*a* and 68*b*, spring 106 which is pressed by screw 68*b* against left plastic pressure piece 66*a* to press left plastic pressure piece 66a against vertical portion 61 of cheek 50 and thereby press vertical portion 61 against right pressure piece 66b to thereby apply a braking force to bracket assembly 500. Adjustment screw 68b thus may be used to adjust the braking force of bracket assembly 500 to slow down movement of holding bracket 54 during stacking of card-shaped products L.

Figure 4B:
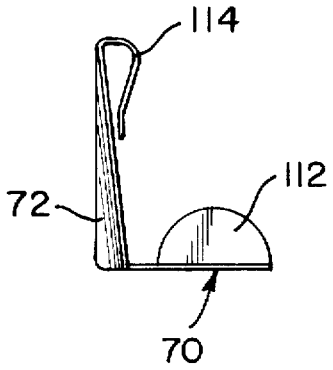
FIGS. 4*a*, 4*b*, and 4*c* are a side elevation, a front elevation, and a top view, respectively, of a structural member that can be mounted on lateral cheeks of the device.
Figure 4A:
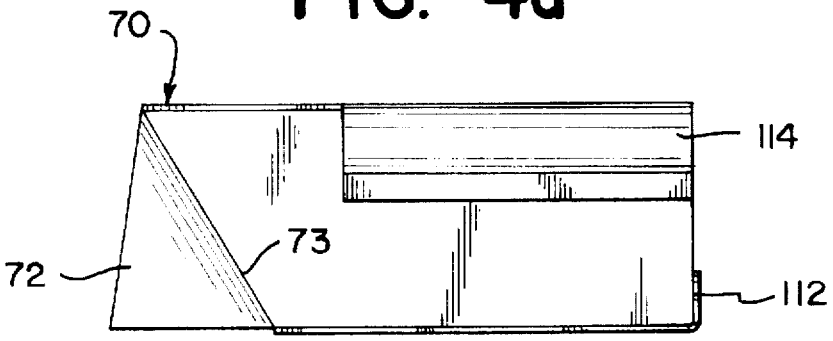
Figure 4C:
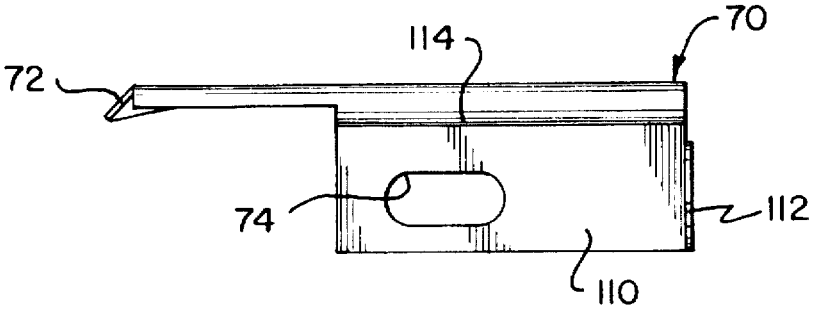

FIGS. 4a through 4c show a structural member 70 that is illustrated in FIG. 1, which is installed along the face of the cheeks 50, 52 facing the conveyor arrangement 2. Structural member 70 has an intake slope 72 (a portion bent along line 73 in a direction away from support surface 10) that is oblique to the transport direction and offset toward the outside. Slope 72 is positioned between two bars 44 of the rocker arm 34. If the cheeks 50 and 52 are more or less exactly adapted to the width of the labels to be stacked, the guide slopes 72 on each cheek guarantee reliable deposit of the labels into the stack, i.e., there is no risk of tilting. A slot guide 74 in horizontal portion 110 of structural member 70 allows the structural member 70 to slide in the longitudinal or stacking direction and to be secured by means of screw 84 (the same screw that is used to adjust the relative positions of cheeks 50, 52). Thus, the position of guide slope 72 may be adjusted longitudinally depending on the position of the rocker arm 34. Each structural member 70 includes an upstanding flange 112 which facilitates the longitudinal sliding of the structural members 70 with respect to cheeks 50, 52, i.e., in the stacking direction (i.e., from left to right in FIG. 1). Each structural member 70 further includes an upper flange 114 that fits through a slit 116 in a respective cheek 50, 52 to extend outside its respective cheek (i.e., upper flanges 114 are not positioned between cheeks 50, 52 as is the remainder of structural member 70). Upper flange 114 prevents structural members 70 from moving out of their positions with respect to cheeks 50, 52 when screw 84 is released. Lower horizontal portion 110 fits through a lower slit 118 (preferably the same length as slit 116) in cheek 50. As may be seen in FIG. 1, structural members 70 do not extend the entire length (i.e., left to right) of their respective cheeks. Moreover, right plastic pressure piece 66b is preferably positioned high enough so that it remains above the top edge of structural member 70 when bracket assembly 500 is adjacent structural member 70.

While the foregoing description and drawings represent the preferred embodiments of the present invention, it will be understood that various additions, modifications, and substitutions may be made without departing from the spirit and scope of the present invention as defined in the accompanying claims.

What is claimed is:

1. A stacking device for stacking card-shaped products that are conveyed one after the other in the direction of their surface plane, said stacking device comprising:

a conveyor arrangement, at least one card-shaped product being conveyed by the conveyer arrangement to a stack of card-shaped products;

a guide device at a downstream end of said conveyor arrangement, said guide device guiding said card-shaped product at least partially into a generally vertical direction of conveyance and depositing said card-shaped product onto the stack of card-shaped products in such a way that the stacked card-shaped products are arranged standing substantially vertically with one longitudinal edge on a support surface;

a drivable rocker arm positioned adjacent said guide device and pressing in a stacking direction against the stack end facing said conveyor arrangement to thereby cause the stack to advance; and a brake stop on said rocker-arm and oblique to the generally vertical direction of conveyance, wherein said brake stop is flexible in the moving direction of the card-shaped products from said conveyor arrangement to the stack, said brake stop intercepting said card-shaped product to stop its movement across the stack generally in the vertical direction of conveyance as it is deposited onto the stack by said guide device.

2. A stacking device as in claim 1, wherein said brake stop is preloaded against the generally vertical direction of conveyance.

3. A stacking device as in claim 2, wherein said brake stop is angled with respect to said rocker arm in the generally vertical direction of the card-shaped products guided from said guide device.

4. A stacking device as in claim 3, wherein said brake stop is pivotable around an axis that runs obliquely to the moving direction of the card-shaped products guided from said guide device.

5. A stacking device as in claim 4, wherein said brake stop is preloaded by a spring.

6. A stacking device as in claim 1, wherein said brake stop is vertically adjustable along said rocker arm.

7. A stacking device as in claim 1, wherein said conveyor arrangement conveys said card-shaped product at least partially into the generally vertical direction of conveyance.

8. A stacking device for stacking card-shaped products that are conveyed one after the other in the direction of their surface plane, said stacking device comprising:

a conveyor arrangement, at least one card-shaped product being conveyed by the conveyor to a stack of card-shaped products;

a guide device at a downstream end of said conveyor arrangement, said guide device guiding said card-shaped product at least partially into a generally vertical direction of conveyance and depositing said card-shaped product onto the stack in such a way that the stacked card-shaped products are arranged standing substantially vertically with one longitudinal edge on a support surface;

a holding bracket defining a front end of the stack in the stacking direction;

a brake device, said brake device braking the movement of said holding bracket so that said holding bracket can selectively slide along the support surface in the stacking direction; and a pair of spaced-apart lateral cheeks extending in the stacking direction and, together with the support surface, forming a stack receiver, wherein said holding bracket is slidably held on said lateral cheeks.

9. A stacking device as in claim 8, wherein the braking force of said brake device is adjustable.

10. A stacking device as in claim 9, wherein said brake device includes a sliding friction stop.

11. A stacking device as in claim 8, wherein said stack receiver is adjustable to the width of the card-shaped products to be stacked.

12. A stacking device as in claim 8, further including a connection bracket, said holding bracket being connected to said connection bracket, said connection bracket engaging said lateral cheeks.

13. A stacking device as in claim 12, wherein said connection bracket engages said cheeks by rollers.

14. A stacking device as in claim 12, wherein said stacking receiver is adjustable to the width of the card-shaped products to be stacked by an adjustable connection between said holding bracket and said connection bracket.

15. A stacking apparatus for card-shaped products that are conveyed consecutively in the direction of their surface plane from a cutting unit connected in series with a printer, said stacking apparatus having a conveyor system comprising:

a belt drive that runs from an input of said stacking apparatus to a stack of card-shaped products on a supporting surface, said belt drive running substantially in the plane of the supporting surface at the stack; and a guiding system that deposits a card-shaped product on the stack at the end of said belt drive in such a manner that the stacked, card-shaped products are disposed with a longitudinal edge on the supporting surface, said guiding system including a guiding plate facing said belt drive, said guiding plate and said belt drive forming a guide slot, said guiding plate acting upon the card-shaped products being moved by said belt drive essentially over the whole of the width of the card-shaped products, wherein said guiding plate is pretensioned in the direction of said belt drive, said guiding system further comprising a spring element facing the stack side of said conveyor system, said spring element forcing a trailing edge of the card-shaped product exiting said guiding plate in the direction of the supporting surface.

16. The stacking apparatus of claim 15, wherein said spring element is formed by a spring-loaded tongue.

17. The stacking apparatus of claim 15, wherein said spring element is provided within a recess of said guiding plate.

18. The stacking apparatus of claim 15, wherein said spring element is pretensioned in the direction of the stack.

19. The stacking apparatus of claim 15, wherein said spring element is disposed centrally with respect to said guiding plate.

20. A stacking device for stacking card-shard products that are conveyed one after the other in the direction of their surface plane, said stacking device comprising:

a conveyor arrangement, at least one card-shaped product being conveyed by the conveyer arrangement to a stack of card-shaped products;

a guide device at a downstream end of said conveyor arrangement, said guide device guiding said card-shaped product at least partially into a generally vertical direction of conveyance and depositing said card-shaped product onto the stack of card-shaped products in such a way that the stacked card-shaped products are arranged standing substantially vertically with one longitudinal edge on a support surface, said stack being moved in a stacking direction away from said guide device as additional card-shaped products are added to the stack; and a stack receiver including the support surface and a pair of lateral cheeks extending in the stacking direction on both sides of the stack said stack receiver further including a holding bracket defining a front end of the stack in the stacking direction and connection brackets connecting the holding bracket to the pair of cheeks.

21. A stacking device as in claim 20, wherein the connection brackets engage the cheeks via rollers.

22. A stacking device as in claim 20, wherein the positions of the cheeks with regard to the width of the stack are adjustable by varying the connection between the holding bracket and the connection brackets.

23. A stacking device as in claim 20, further including a sliding brake connected to said holding bracket.

24. A stacking device for stacking card-shaped products that are conveyed one after the other in the direction of their surface plane, said stacking device comprising:

a conveyor arrangement, at least one card-shaped product being conveyed by the conveyer arrangement to a stack of card-shaped products;

a guide device at a downstream end of said conveyor arrangement, said guide device guiding said card-shaped product at least partially into a generally vertical direction of conveyance and depositing said card-shaped product onto the stack of card-shaped products in such a way that the stacked card-shaped products are arranged standing substantially vertically with one longitudinal edge on a support surface, said stack being moved in a stacking direction away from said guide device as additional card-shaped products are added to the stack; and a stack receiver including the support surface and a pair of lateral cheeks extending in the stacking direction on both sides of the stack, wherein the positions of the cheeks in the stacking direction are adjustable.

25. A stacking device for stacking card-shaped products that are conveyed one after the other in the direction of their surface plane, said stacking device comprising:

a conveyor arrangement, at least one card-shaped product being conveyed by the conveyer arrangement to a stack of card-shaped products;

a guide device at a downstream end of said conveyor arrangement, said guide device guiding said card-shaped product at least partially into a generally vertical direction of conveyance and depositing said card-shaped product onto the stack of card-shaped products in such a way that the stacked card-shaped products are arranged standing substantially vertically with one longitudinal edge on a support surface, said stack being moved in a stacking direction away from said guide device as additional card-shaped products are added to the stack; and a stack receiver including the support surface and a pair of lateral cheeks extending in the stacking direction on both sides of the stack, further including structural members at the ends of the cheeks towards the guide device, said structural members having guide slopes to guide the card-shaped products onto the stack.

26. A stacking device as in claim 25, wherein said structural members are adjustable with regard to the cheeks in the stacking direction.

* * * * *